US010869806B2

(12) United States Patent
Kopnicky

(10) Patent No.: US 10,869,806 B2
(45) Date of Patent: Dec. 22, 2020

(54) THERAPEUTIC SYSTEMS AND ROLLER DEVICES AND METHODS OF USE

(71) Applicant: Robert Jerome Kopnicky, Laporte, IN (US)

(72) Inventor: Robert Jerome Kopnicky, Laporte, IN (US)

( * ) Notice: Subject to any disclaimer, the term of this patent is extended or adjusted under 35 U.S.C. 154(b) by 1315 days.

(21) Appl. No.: 15/044,434

(22) Filed: Feb. 16, 2016

(65) Prior Publication Data

US 2017/0020772 A1 Jan. 26, 2017

Related U.S. Application Data

(60) Provisional application No. 62/115,740, filed on Feb. 13, 2015.

(51) Int. Cl.
*A61H 15/00* (2006.01)

(52) U.S. Cl.
CPC ..... *A61H 15/00* (2013.01); *A61H 2015/005* (2013.01); *A61H 2015/0035* (2013.01); *A61H 2201/0119* (2013.01); *A61H 2201/0134* (2013.01); *A61H 2201/1253* (2013.01); *A61H 2201/1261* (2013.01); *A61H 2201/169* (2013.01); *A61H 2201/1623* (2013.01); *A61H 2201/1635* (2013.01); *A61H 2201/1645* (2013.01); *A61H 2201/1669* (2013.01); *A61H 2201/1695* (2013.01); *A61H 2205/065* (2013.01); *A61H 2205/067* (2013.01); *A61H 2205/081* (2013.01)

(58) Field of Classification Search
CPC .... A61H 15/00; A61H 15/0092; A61H 15/02; A61H 2015/0007; A61H 2015/0014; A61H 2015/0021; A61H 2015/0028; A61H 2015/0035; A61H 2015/0042; A61H 2015/005; A61H 2015/0057
See application file for complete search history.

(56) References Cited

U.S. PATENT DOCUMENTS

| | | | |
|---|---|---|---|
| 896,484 | A | 8/1908 | Thoms |
| 1,111,427 | A | 9/1914 | Archibald |
| 1,572,794 | A | 8/1922 | Hamilton |
| 3,548,814 | A | 12/1970 | Montgomery et al. |
| 3,750,654 | A | 8/1973 | Shiu |
| 3,970,078 | A | 7/1976 | Rogers, Jr. |
| 4,648,387 | A | 3/1987 | Simmons |

(Continued)

*Primary Examiner* — Michael J Tsai
(74) *Attorney, Agent, or Firm* — Hartman Global IP Law; Gary M. Hartman; Domenica N. S. Hartman

(57) ABSTRACT

Roller devices, systems, and methods for their use to treat or alleviate symptoms relating to soft tissue injuries and ailments. Such a therapeutic system includes at least one roller device that has an axis of rotation and at least first and second rollers oriented perpendicular to the axis of rotation and spaced apart along the axis of rotation to provide substantially continuous lines of contact with an individual's skin. Each of the rollers has a circular perimeter that defines an outer diameter and a contact surface of the roller. The contact surface defines a contact surface radius sized so that the roller applies a level of pressure to the soft tissue beneath the skin when the roller device is pressed with a level of force against the skin of the individual and caused to travel across the skin within the body region of the individual's body.

22 Claims, 12 Drawing Sheets

(56) References Cited

U.S. PATENT DOCUMENTS 5,588,953 A 12/1996 Chang
5,711,758 A 1/1998 Tseng
5,997,489 A 12/1999 Iwamoto et al.
6,436,062 B1 8/2002 Iwamoto et al.
6,881,195 B2 4/2005 Wu
6,899,688 B2 5/2005 Wu
6,974,427 B1 * 12/2005 Lapham ..... A61H 15/00 601/120
9,039,640 B2 5/2015 Crowell et al.
9,101,524 B2 8/2015 Aghion
9,107,795 B2 8/2015 Faussett
9,132,055 B1 9/2015 Wallace
9,149,410 B2 10/2015 Justice Velasco
9,241,865 B2 1/2016 Johnson
2006/0235343 A1 * 10/2006 Fitzmaurice ..... A61H 15/0092 601/131
2010/0145243 A1 * 6/2010 Kantor ..... A61H 15/00 601/118
2011/0245741 A1 * 10/2011 L'Homme ..... A61H 15/0085 601/120
2011/0257569 A1 * 10/2011 Robins ..... A61H 15/00 601/137
2011/0313333 A1 * 12/2011 Nicholson ..... A61H 15/0092 601/120
2014/0114221 A1 * 4/2014 Indermill ..... A61H 15/00 601/120
2014/0358050 A1 * 12/2014 Stock ..... A61H 15/0092 601/119
2015/0374576 A1 * 12/2015 Dagan ..... A61H 7/003 601/119
2016/0008213 A1 * 1/2016 Cheng ..... A61H 15/0092 601/120
2016/0113837 A1 * 4/2016 Burson ..... A61H 15/0092 601/118

* cited by examiner

THERAPEUTIC SYSTEMS AND ROLLER DEVICES AND METHODS OF USE

CROSS REFERENCE TO RELATED APPLICATIONS

This application claims the benefit of U.S. Provisional Application No. Ser. No. 62/115,740, filed Feb. 13, 2015, the contents of which are incorporated herein by reference.

BACKGROUND OF THE INVENTION

The present invention generally relates to devices and methods for use in physical therapy performed on or by individuals, and particularly to devices and methods that can be used by an individual to treat or alleviate symptoms relating to soft tissue injuries and ailments associated with a variety of medical conditions, nonlimiting examples of which include carpal tunnel syndrome and conditions relating to lymphatic fluid.

BRIEF DESCRIPTION OF THE INVENTION

The present invention provides roller devices, systems, and methods for their use to treat or alleviate symptoms relating to soft tissue injuries and ailments associated with certain medical conditions.

According to one aspect of the invention, a therapeutic system is provided that is adapted to perform therapy on soft tissue beneath the skin within a body region of an individual's body through a rolling application of pressure. The system includes at least a first roller device that has an axis of rotation and at least first and second rollers oriented perpendicular to the axis of rotation and spaced apart along the axis of rotation to provide substantially continuous lines of contact with the individual's skin. Each of the first and second rollers has a circular perimeter that defines an outer diameter and a contact surface of the roller. The contact surface defines a contact surface radius sized so that the roller applies a level of pressure to the soft tissue beneath the skin when the first roller device is pressed with a level of force against the skin of the individual and caused to travel across the skin within the body region of the individual's body.

Other aspects of the invention include methods of using roller devices and therapeutic systems of the types described above.

Technical effects of roller devices and therapeutic systems encompassed by the above preferably include the ability of the roller devices be rolled across the skin of an individual with sufficient pressure to treat or alleviate symptoms relating to soft tissue injuries and ailments beneath the skin, nonlimiting examples of which include carpal tunnel syndrome, conditions relating to lymphatic fluid or the lymph nodes, blood circulation, muscle, tendon and ligament damage or injuries, scar tissue, and other medical conditions.

Other aspects and advantages of this invention will be better appreciated from the following detailed description.

BRIEF DESCRIPTION OF THE DRAWINGS

FIG. 1 shows the support as supporting a roller device and a forearm and hand of an individual, wherein the hand overlies and contacts the roller device and has a bidirectional motion to perform therapy on portions of the forearm and hand in accordance with a nonlimiting embodiment of this invention.

FIG. 3 represents a unidirectional progression of a roller device beneath the forearm and hand of an individual as the device advances from the fingertips toward the elbow as a result of the individual moving their hand and arm. FIGS. 4 and 5 represent bidirectional movements of two different roller devices beneath the hand of an individual as the devices are caused to move between the fingertips and wrist of the individual as a result of the individual moving their hand. FIG. 6 represents a bidirectional movement of a roller device beneath the hand of an individual as the device is caused to move from side to side of the palm of the individual as a result of the individual moving their hand in a direction transverse to the bidirectional motions of FIGS. 4 and 5.

DETAILED DESCRIPTION OF THE INVENTION

Figure 1:
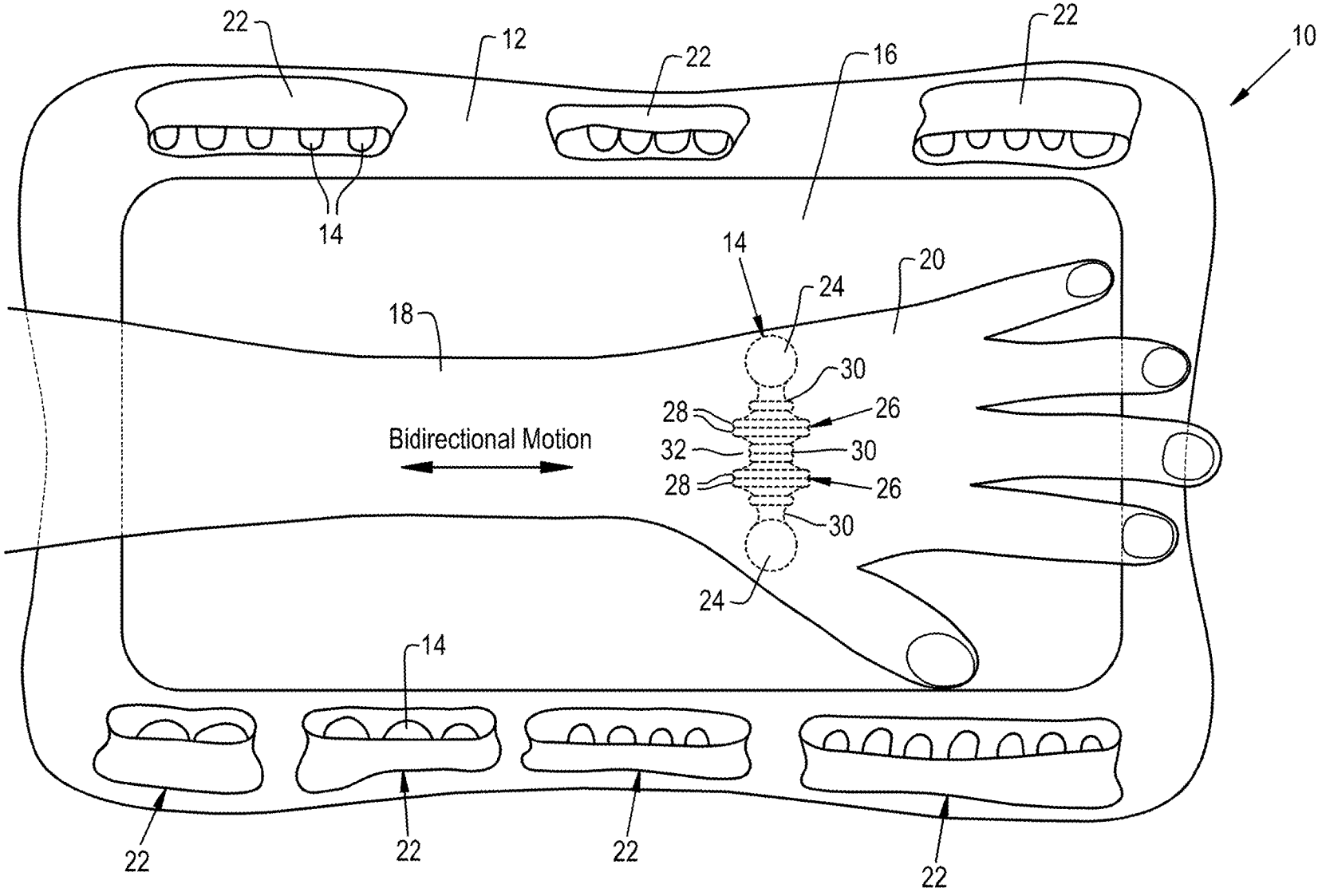
FIGS. 1 and 2 represent top and cross-sectional views of a portable cushion or support.

FIGS. 1 through 16 represent various roller devices and therapy systems adapted to be rolled across the skin of an individual. The roller devices are of types that experimentally appear to treat or alleviate symptoms relating to soft tissue injuries and ailments when used to apply a rolling application of sufficient pressure in the body region beneath the skin wherein a soft tissue injury or ailment exists. While various roller devices and therapeutic systems containing one or more roller devices are represented in the drawings and will be discussed below, the roller devices share common features, including a single axis of rotation that enables the device to be rolled across the skin and two or more rollers that are oriented perpendicular to the axis and provide substantially continuous lines of contact with the skin to apply pressure to soft tissue beneath. In view of these similarities and as a matter of convenience, identical reference numerals are used throughout the drawings to denote roller devices and certain features of the devices.

Figure 2:
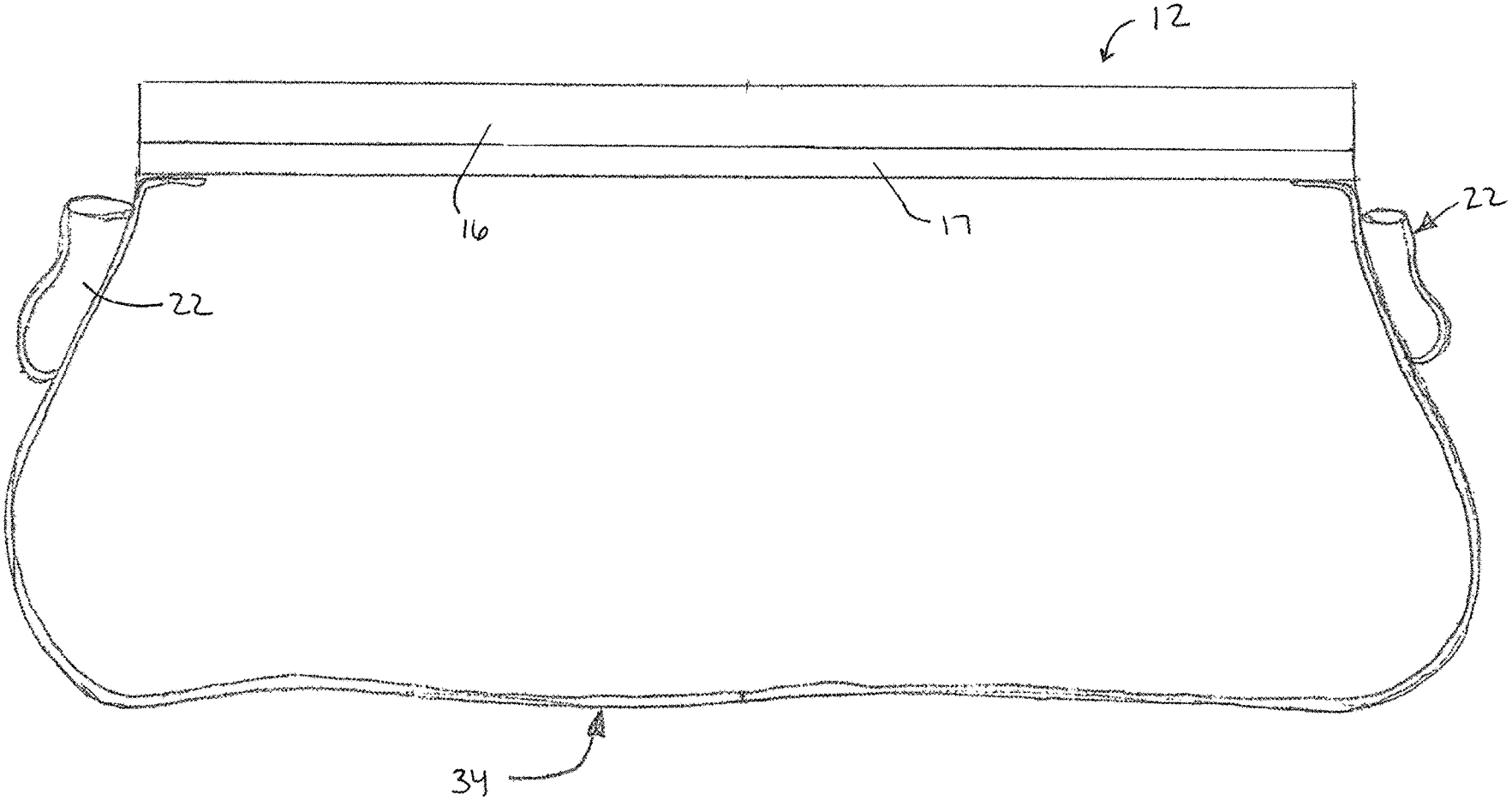

FIGS. 1 and 2 represent a therapy system 10 that includes a portable cushion or support 12 and a roller device 14. FIGS. 1 and 2 represent top and cross-sectional views, respectively, of the therapy system 10. The support 12 provides a soft nonrigid substrate 16, for example, a foam pad. For use on some surfaces, the substrate 16 may be supported from beneath by a more rigid substrate 17, for example, a flat rigid panel (FIG. 2), which in turn is represented as being supported by an optional bean bag 34 or other sufficiently pliant material that can be placed and supported on the arm of a chair or the user's lap. FIG. 1 shows the forearm 18 and hand 20 of an individual overlying the roller device 14, which is supported by the nonrigid substrate 16 such that the roller device 14 is between a body region (hand 20) of the individual, contacts the body region and substrate 16, and travels along the length of the forearm 18 and hand 20 when the individual moves their forearm to have the bidirectional motion indicated in FIG. 1. The support 12 is represented as including pouches 22 adapted to contain the roller device 14 and additional roller devices 14 for use with the therapy system 10.

The roller device 14 depicted in FIG. 1 (identified as "C15" in FIG. 7) has two end portions 24 at oppositely-disposed axial ends of the device 14 and two rollers 26 therebetween, all concentrically located on an axis of rotation of the device 14 and fixed relative to each other so that they simultaneously rotate with each other. The rollers 26, each represented as comprising a pair of disks 28 of equal size and shape, are more prominent (i.e., have a larger diameter) than the end portions 24 and ribbed axle portions 30 of the device 14 disposed between the end portions 24 and rollers 26, such that an axial gap 32 exists between the rollers 26. The end portions 24, rollers 26, and axle portions 30 are sized and distributed along the axis of the device 14 such that the device 14 is symmetrical about the gap 32. The rollers 26 are intended to apply approximately equal levels of pressure to the body region contacted by the device 14, with each roller 26 providing a substantially continuous line of contact with the skin and the soft tissue beneath. As noted above, as the individual moves their forearm 18 and hand 20 to have the bidirectional motion indicated in FIG. 1, the roller device 14 contacts the body region (forearm 18 and hand 20) and substrate 16 and travels along the length of the forearm 18 and hand 20. The substrate 16 is sufficiently pliable so that the roller device 14 is pressed into the substrate 16 so that the individual is better able to control the bidirectional movement of the device 14. Therapeutic benefits may include promoting the flow of lymphatic fluid and/or blood out of the individual's hand and through the forearm.

The substrate 16 of the support 12 represented in FIGS. 1 and 2 is preferably a closed-cell foam, for example, neoprene, with essentially no memory. In addition, the substrate 16 preferably has a thickness of at least one-half inch (about 1 cm), more preferably about one inch (about 2.5 cm), so that when supported by the rigid substrate 17 or other rigid surface, the more pliable substrate 16 allows for sufficiently deep penetration of the roller device 14 to cause a drag that resists rolling of the device 14. Such a substrate 16, when used in combination with a roller device 14 of types disclosed herein, is capable of providing various benefits. For example, the rigidly-supported substrate 16 is believed to provide one or more of the following benefits: provides a cushion of contact for the skin contact area; improves control of the roller device 14 by the user; slows the rolling action of the roller device 14; promotes penetration of the roller device 14 at the contact points on the body; allows the user to control the pressure level of contact; and/or increases the sensitivity of the roller device 14 in motion (back and forth, side to side).

Figure 3:
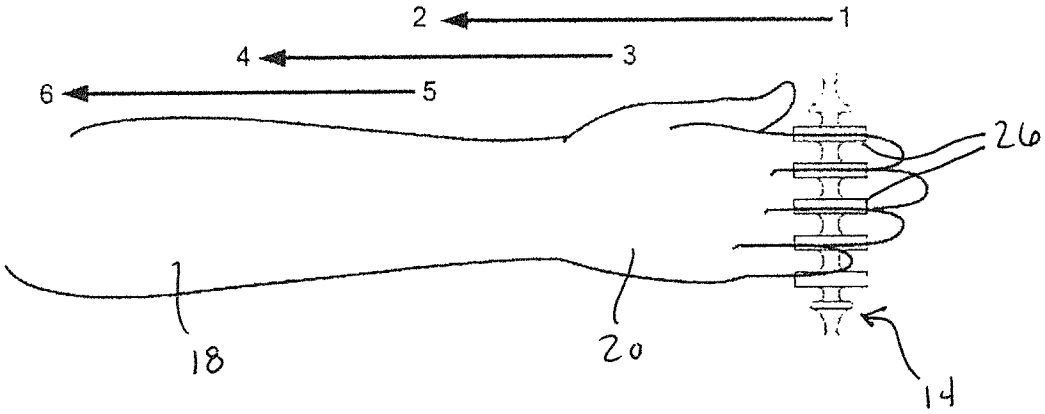
FIGS. 3 through 6 represent a series of therapies that can be performed with the support represented in FIG. 1 using a series of different roller devices.

FIGS. 3 through 6 represent a series of images similar to the top view of FIG. 1, but do not show the support 12 for purposes of clarity. FIG. 3 shows a different roller device 14 than what is represented in FIG. 1, and also represents a unidirectional progression of the device 14 beneath the hand 20 and forearm 18 of an individual as the device 14 advances from the fingertips toward the elbow as a result of the individual moving their hand 20 and forearm 18. The roller device 14 depicted in FIG. 3 has five rollers 26 that are all disk-shaped, have equal diameters, are concentrically located on the axis of rotation of the device 14, are equally spaced along the axis of rotation, and are fixed relative to each other so that they simultaneously rotate with each other. This particular roller device 14 (identified as "L1" in FIG. 7), is believed to be effective in pushing lymphatic fluid from the hand 20 toward the forearm 18 when used in the manner represented in FIG. 3. In use, the roller device 14 can be placed at one end of the substrate 16 where that hand 20 will be placed, so that the tips of the fingers rest on the roller device 14. Using mild pressure, the hand 20 is slowly pushed forward to cause the roller device 14 to roll across the substrate 16. As the roller device 14 moves along the substrate 16, it progresses from the fingers to the hand 20, wrist, and then forearm 18. As indicated by the series of unidirectional arrows in FIG. 3, once the roller device 14 passes the wrist, the device 14 is again placed near the one end of the substrate 16, the palm of the hand 20 is placed on the roller device 14, and the hand 20 is slowly pushed forward to cause the roller device 14 to roll across the substrate 16 while progressing from the hand 20 to the wrist and then forearm 18. The third progression shown in FIG. 3 is to repeat the process with the roller device 14 initially placed beneath the forearm 18 and cause the device 14 to progress toward the elbow. Each of these steps may be repeated for several minutes.

Figure 4:
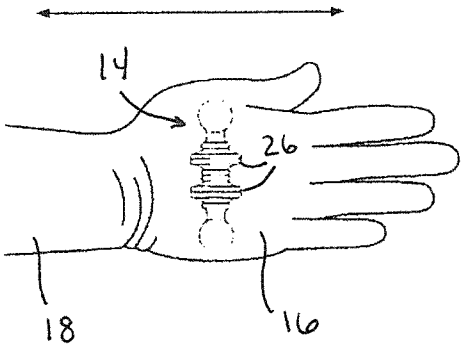
Figure 6:
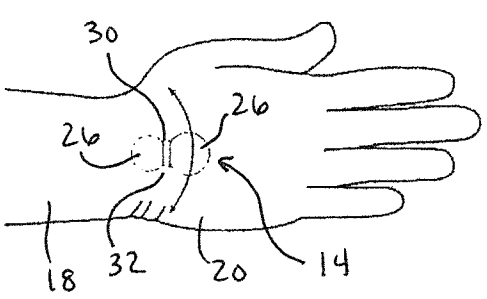
Figure 5:
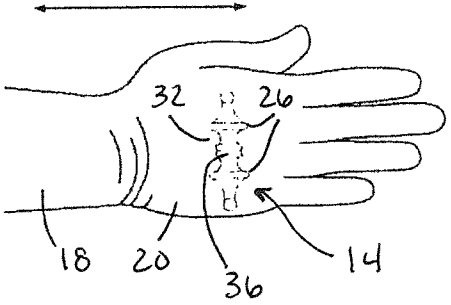

The roller devices 14 depicted in FIGS. 4, 5 and 6 are intended to have a different therapeutic effect compared to the device 14 of FIG. 3, namely, to relieve swelling, pain, stiffness, and tension caused by carpal tunnel. The roller device 14 depicted in FIG. 4 is configured identically to the device 14 shown in FIG. 1, and a bidirectional motion is indicated across the palm of the hand between the fingers and wrist. The device 14 depicted in FIG. 4 is particularly intended to exercise the lymphatic and circulatory systems check valves in and around the hand 20 and wrist by placing the device 14 at the junction between the fingers and palm, then pushing the device 14 a few inches past the wrist, and then rolling the device 14 back again to the junction between the fingers and palm. This step may be repeated for several minutes with a comfortable amount of pressure.

The device 14 depicted in FIG. 5 (identified as "C5" in FIG. 7) differs by being shorter in length and having two rollers 26 that are smaller than the rollers 26 depicted in FIG. 3 but otherwise are equally spaced along the axis of the device 14, are disk-shaped, and have roughly equal diameters. The device 14 depicted in FIG. 5 also differs by having two ribs 36 that are between the rollers 26, have circular perimeters, and are smaller in diameter than the rollers 26 but more prominent than axle portions 30 of the device 14 disposed between the ribs 36 and rollers 26, such that the ribs 36 radially project within an axial gap 32 between the rollers 26. As with FIG. 4, a bidirectional motion is indicated across the palm of the hand 20 between the fingers and wrist. This step may be repeated for several minutes with a comfortable amount of pressure. The device 14 depicted in FIG. 5 is particularly intended to stretch the carpal ligament between the palm and wrist while also stripping adhesions throughout.

The device 14 depicted in FIG. 6 (identified as "C8" in FIG. 7) differs in part from the devices 14 shown in FIGS. 1, 3, 4 and 5 by being shorter in length and having two rollers 26 of different outer diameters that are separated by a single axle portion 30 of the device 14 that defines an axial gap 32 between the rollers 26. The different outer diameters of the rollers 26 can be used to apply different levels of pressure with the rollers 26. Notably, the resulting asymmetry of the device 26 along its axis of rotation facilitates the bidirectional motion indicated in FIG. 6 by placing the larger diameter roller 26 closer to the fingers. The bidirectional motion indicated in FIG. 6 is widthwise across the palm of the hand 20, transverse to the unidirectional and bidirectional motions represented in FIGS. 1, 3, 4 and 5.

Figure 7:
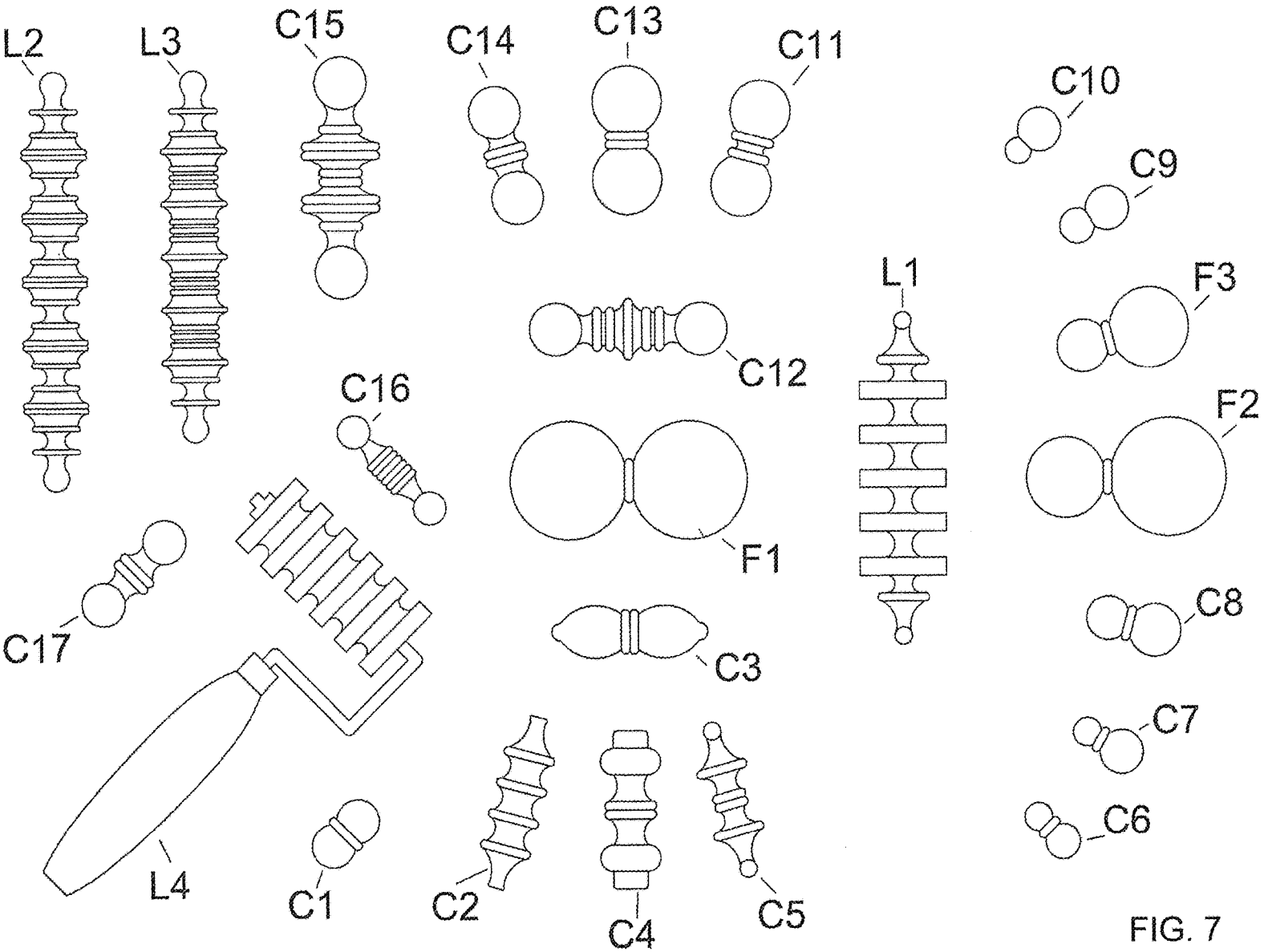
FIG. 7 represents an assortment of roller devices that may be provided as a set or kit of a therapy system in accordance with a nonlimiting embodiment of this invention.

As previously noted, the roller devices 14 share common features, including a single axis of rotation that enables the device 14 to be rolled across the skin and two or more rollers 26 that are oriented perpendicular to the axis and provide substantially continuous lines of contact with the skin to apply pressure to soft tissue beneath. FIG. 7 represents an assortment of roller devices (labeled as L1 through L4, C1 through C15, and F1 through F3) that may be provided as a set or kit for use with therapy systems within the scope of this invention, including but not limited to the system 10 represented in FIGS. 1 and 2. As evident from FIGS. 1 and 3 through 7, the number (two or more), axial spacing (widths of the gap(s) 32), shapes (e.g., disk-shaped, spherical-shaped, ovoid-shaped, etc.), widths (contact surfaces), and outer diameters of the rollers 26 are intentionally varied to achieve particular therapeutic effects. The rollers 26 of each device 14 represented in FIG. 7 are preferably fixed relative to each other so that they simultaneously rotate with each other. The placement, shapes, and diameters of the rollers 26 are capable of modifying the pressure applied with the device 14. The roller devices 14 of FIGS. 1 and 3 through 7 can be used in various combinations and sequences to create different contact pressures simultaneously and substantially continuously along lines of contact with the skin and the soft tissue beneath, wherein the number of contact lines and distances between contact liners are determined by the number of rollers 26 and distances between rollers 26. In practice, these roller devices 14 appear to promote stretching of the carpal ligaments, reduce pressure on nerves, and reduce numbness.

FIG. 7 represents one of the roller devices 14 (L4) as equipped with a single handle for applying a unidirectional or bidirectional motion to perform therapy on portions of an individual's body. The L4 device 14, which utilizes rollers 26 that are similar in shape, diameter and spacing to the rollers 26 of the L1 device 14 of FIG. 3, is believed to be particularly well suited for use on the hands and arms to promote the flow of lymphatic fluid away from the hands and arms.

Figure 8:
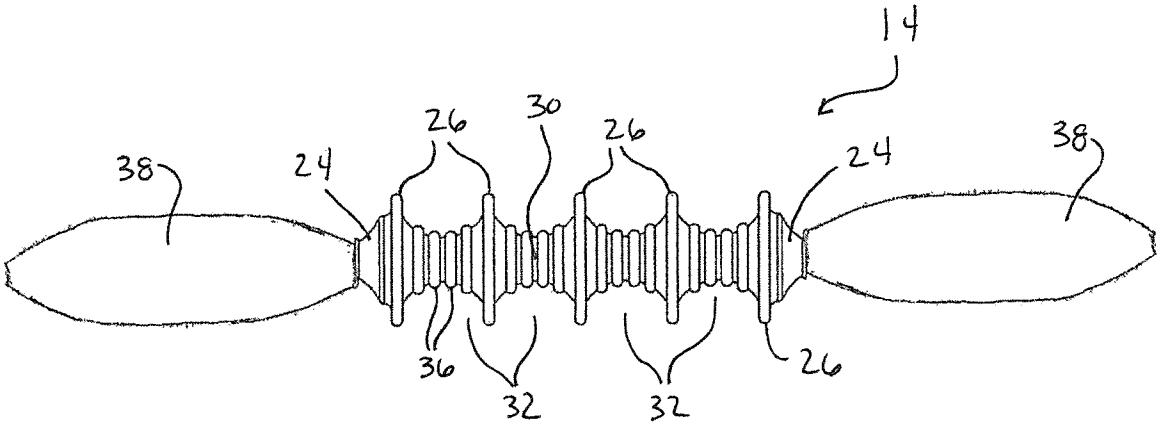
FIG. 8 represents a roller device equipped with handles for achieving a unidirectional or bidirectional motion to perform therapy on portions of an individual's body in accordance with nonlimiting embodiments of this invention.

FIG. 8 represents another roller device 14 equipped with two handles 38 mounted at oppositely-disposed ends of its axis of rotation so that the rollers 26 are between the handles 38 and simultaneously rotate with each other but not with the handles 38. The device 14 shown in FIG. 8 has fewer rollers 26 than the L4 device 14 of FIG. 7. In addition, the rollers 26 of the device 14 in FIG. 8 have significantly narrower widths (contact surfaces) and are axially spaced farther apart than the rollers 26 of the L4 device 14 in FIG. 7. The device 14 shown in FIG. 8 is also adapted to apply a unidirectional or bidirectional motion to perform therapy on portions of an individual's body, for example, on the arms and legs to manipulate muscle and other deep soft tissues, promote the treatment of adhesions, and break down collagen scar tissue. For some therapeutic treatments, the device 14 of FIG. 8 can be used while a body region of an individual rests on the support 12 of FIGS. 1 and 2, for example, if a therapist is treating the arm, hand, or fingers of the individual.

Figure 9:
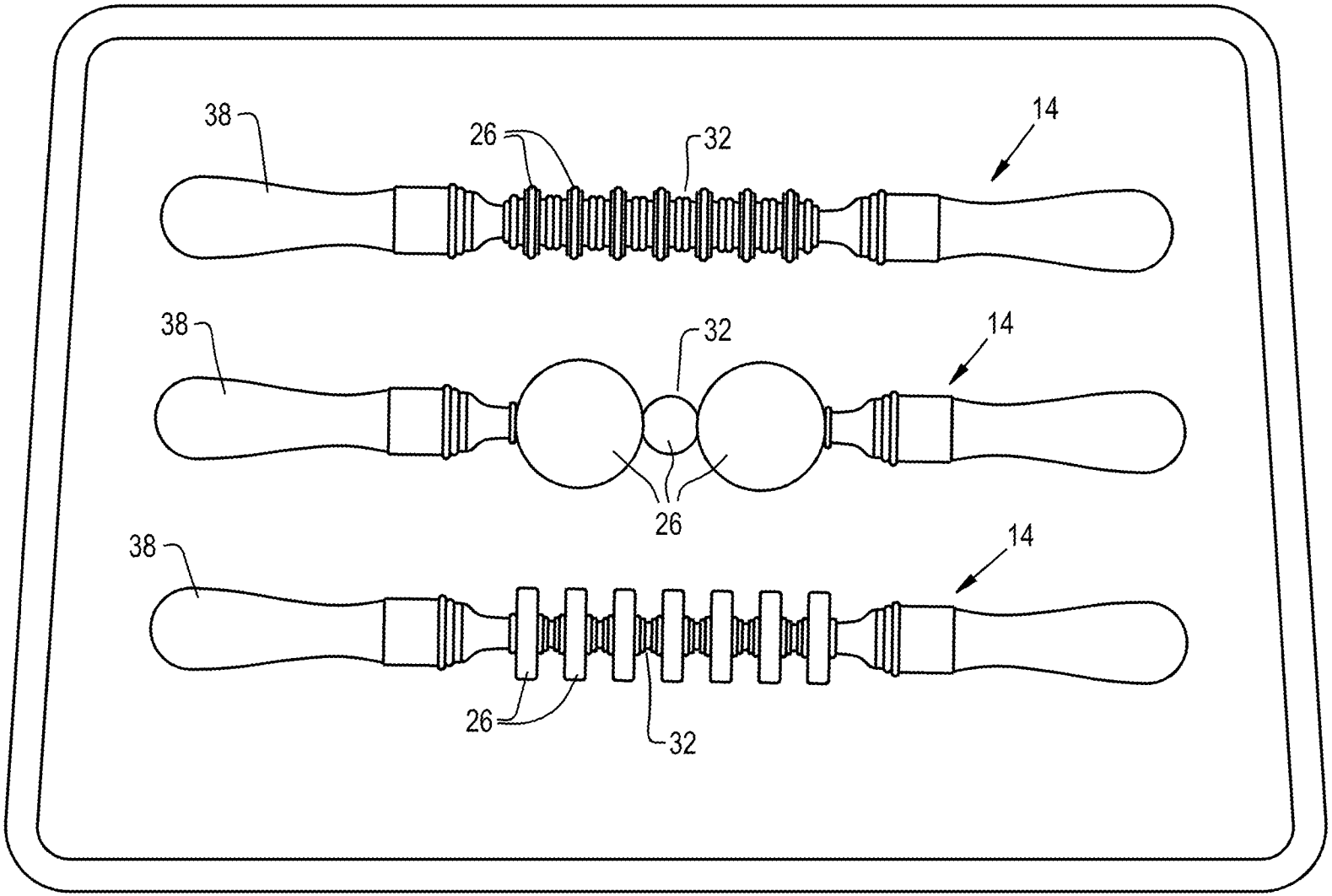
FIG. 9 represents an assortment of roller devices each equipped with handles and provided as a set or kit of a therapy system in accordance with a nonlimiting embodiment of this invention.

FIG. 9 represents a kit comprising three roller devices 14 each equipped with handles 38. Compared to the middle and lower devices 14 in FIG. 9, the upper device 14 has rollers 26 of smaller diameter, narrower widths (contact surfaces), and ribs 36 between rollers 26. The lower device 14 has an equal number of rollers 26 (seven), but has narrower axial gaps 32 as a result of having wider rollers 26 that define essentially flat contact surfaces. The middle roller device 14 in FIG. 9 has two large spherical rollers 26 and a smaller spherical roller 26 therebetween and contacting the larger spherical rollers 26. The roller devices 14 of this kit are believed to be particularly well suited for use on the shoulders, neck, arms and legs. The upper and lower devices 14 are believed to manipulate muscle and other deep soft tissues, promote the treatment of adhesions, and break down collagen scar tissue. The gap 32 between the larger spherical rollers 26 of the middle device 14 is sufficiently wide to accommodate the bones of the neck, arms and legs while supporting the device 14 on the surrounding tissue to vigorously massage and work the tissue, while any pressure applied by the smaller spherical roller 26 is preferably much lower.

Figure 10:
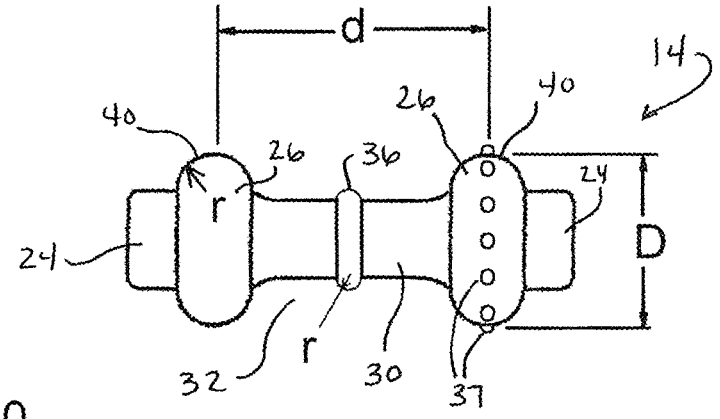
FIG. 10 is a schematic representation of a generic roller device.

FIG. 10 is a generic representation of a roller device 14 corresponding to any of the devices 14 discussed above, in that the device 14 has an axis of rotation, two end portions 24 at oppositely-disposed axial ends of the device 14, rollers 26 between the end portions 24 concentrically located on the axis of rotation and fixed relative to each other so that they simultaneously rotate with each other, and an axle portion 30 disposed between the rollers 26 such that an axial gap 32 exists between the rollers 26. The roller device 14 is also schematically represented as having a rib 36 within the gap 32 midway between the rollers 26, and shows one of the rollers 26 equipped with discrete protrusions or bumps 37. The end portions 24, rollers 26, and axle portion 30 are sized and distributed along the axis of the device 14 such that the device 14 is symmetrical about the gap 32, though such symmetry is not required in all embodiments as evident from FIG. 7. Furthermore, the rollers 26 are represented as being of equal size and shape (disk-shaped), though asymmetrical sizes and other shapes (such as shown in FIG. 7) are within the scope of the invention. The illustration of the roller device 14 in FIG. 10 is intended to identify the certain features present in the illustrated embodiments, including the perpendicular orientation of the rollers 26 to the axis of rotation, a distance "d" between adjacent rollers 26, a circular perimeter of each roller 26 that defines an outer diameter "D" and contact surface 40 of the roller 26, and a contact surface radius "r" that is defined by the contact surface 40 and influences the level of pressure applied by the roller 26 to the skin and soft tissue beneath the skin when the roller device 14 is pressed with a given level of force against the skin. In particular, for a given application force a larger radius r (corresponding to a greater axial width or thickness of the roller 26) decreases pressure by distributing the force across a larger surface area of the skin, whereas a smaller radius r (corresponding to a lesser axial width or thickness of the roller 26) increases pressure by distributing the force across a smaller surface area of the skin. As such, different therapeutic effects can be achieved by using different roller devices 14 having rollers 26 with different outer diameters D and/or different contact surface radii r, and/or using a single roller device 14 having rollers 26 with outer diameters D and/or different contact surface radii r. In addition, the optional rib (or ribs) 36 and bumps 37 can further modify the therapeutic effect of the device 14, for example, the bumps 37 may be effective to fire trigger points, as would be understood by those skilled in the art.

Nonlimiting examples of suitable dimensions for the rollers 26 generally include the following. Suitable outer diameters (D) are believed to be in a range of about 1 to about 2.5 centimeters, and suitable contact surface radii (r) are believed to be at least 0.3 centimeter. Rollers 26 with essentially flat contact surfaces 40 (for example, the L1 device 14 of FIGS. 3 and 7, the L4 device 14 of FIG. 7, and the lower device 14 of FIG. 9) have contact surface radii of infinity. Rollers 26 with essentially spherical shapes have contact surface radii of up to one-half of their outer diameters. In addition, suitable axial distances (d) between rollers 26 are believed to be at least 1.5 up to about 6 centimeters. Therapeutic effects can also be modified by providing one or more ribs 36 within the gap(s) 32 between rollers 26, as shown in FIG. 5 as a result of each rib 36 having a contact surface radius that is less than the contact surface radii of the rollers 26. Though the outer diameters of the ribs 36 are less than the outer diameters of the rollers 26, the ribs 36 may yet contact the skin and apply pressure as a result of the relative sizes of their outer diameters and the distance between adjacent rollers 26.

Figure 11:
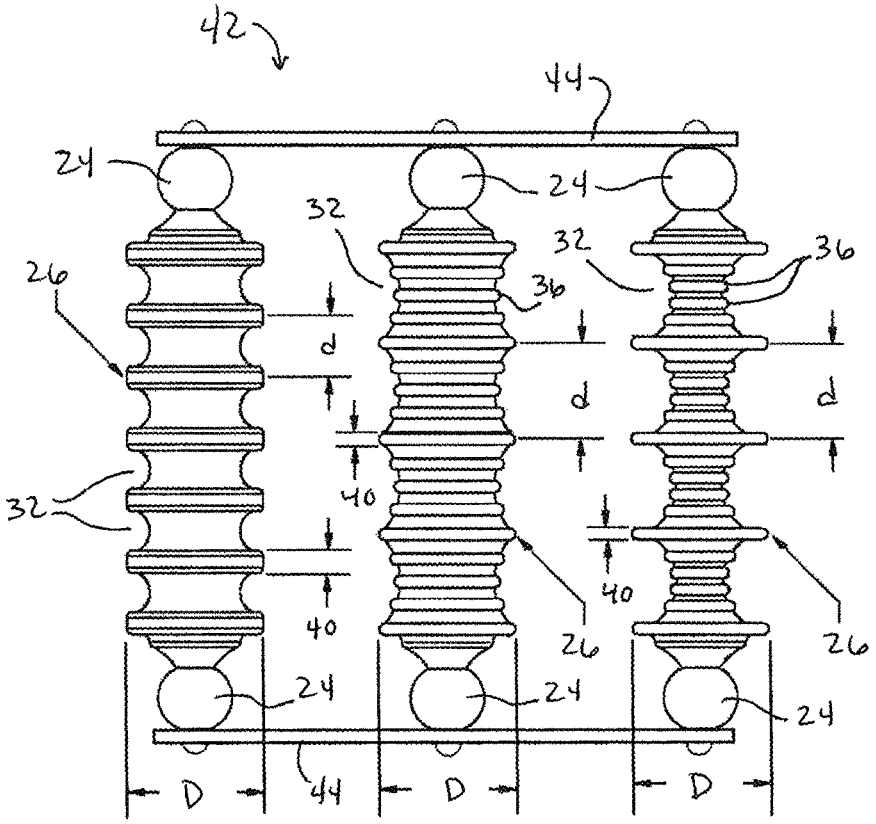
FIG. 11 represents a therapy system comprising different roller devices that are interconnected in parallel in accordance with a nonlimiting embodiment of this invention.

FIG. 11 represents a roller assembly 42 comprising three different roller devices 14 that are interconnected at their end portions 24 with brackets 44 to be independently rotatable relative to each other. The roller devices 14 are of substantially identical length and interconnected in parallel so that they move in sequence in the direction(s) of travel. As a nonlimiting example, unidirectional motion of the roller assembly 42 can be used to promote the flow of lymphatic fluid and/or blood away from the fingers and hand and into the arm. The roller assembly 42 and its individual roller devices 14 (which can be used separately and independently from each other) are especially adapted to perform therapy on an individual's fingers. The rollers 26 of each of the middle and righthand devices 14 define four axial gaps 32, each sized to receive an individual finger. When the corresponding device 14 is moved unidirectional away from the finger tips and toward the hand, ribs 36 within each gap 32 are believed to promote the flow of lymphatic fluid and blood out of the fingers and into the hand to reduce swelling and free up check valves. The lefthand roller device 14 in FIG. 11 is similar to the L1 roller device 14 represented in FIGS. 3 and 7, noted for being particularly intended to promote the flow of lymphatic fluid. By interconnecting the roller devices 14 in the manner shown, the resulting assembly 42 provides a unit that can simultaneously or sequentially perform several different therapeutic modalities.

Figure 12:
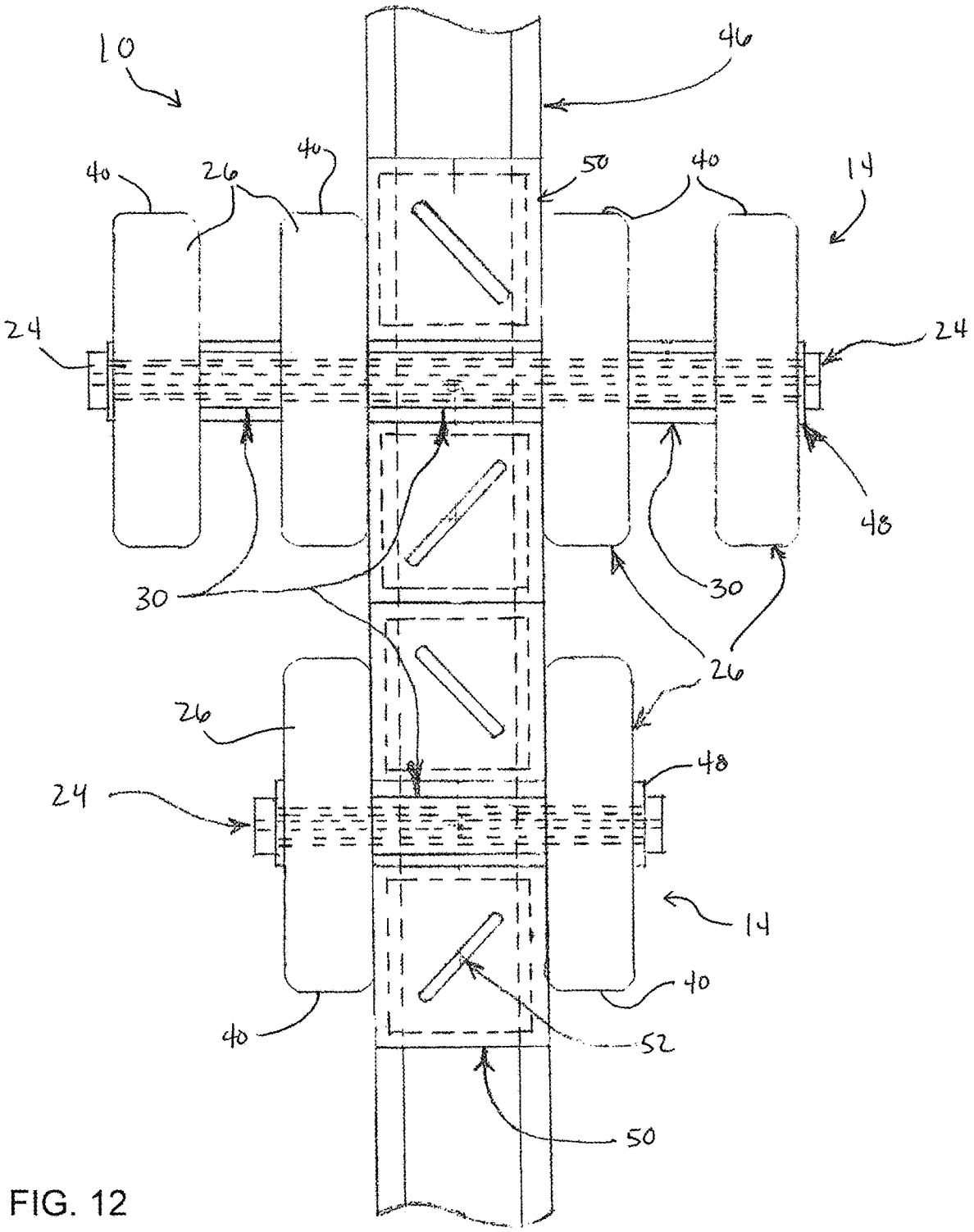
FIGS. 12, 13, and 14 represent front, top, and side views of a therapy system comprising multiple roller devices that are mounted parallel to each other and configured for mounting to a wall in accordance with nonlimiting embodiments of this invention.
Figure 13:
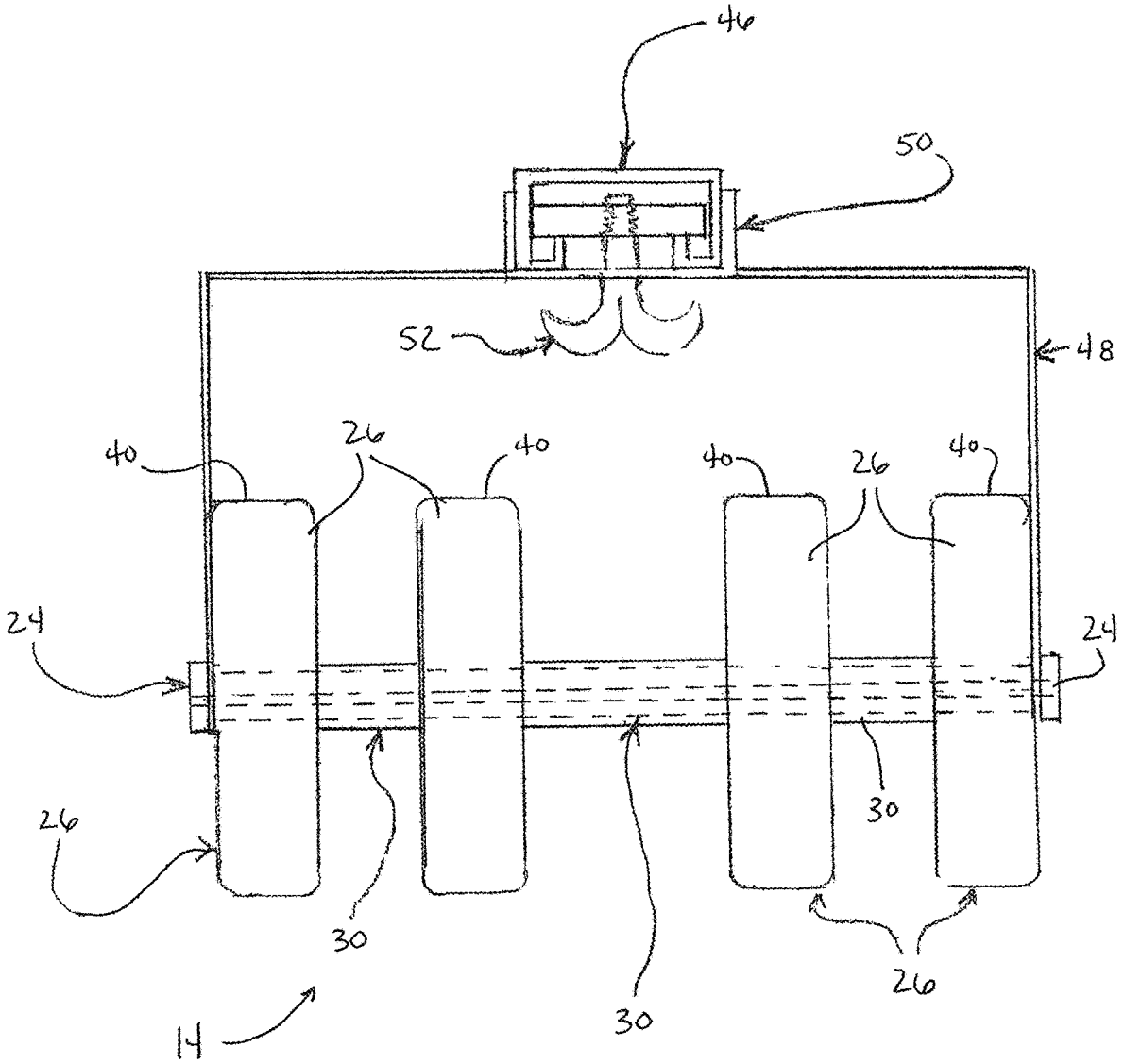
Figure 14:
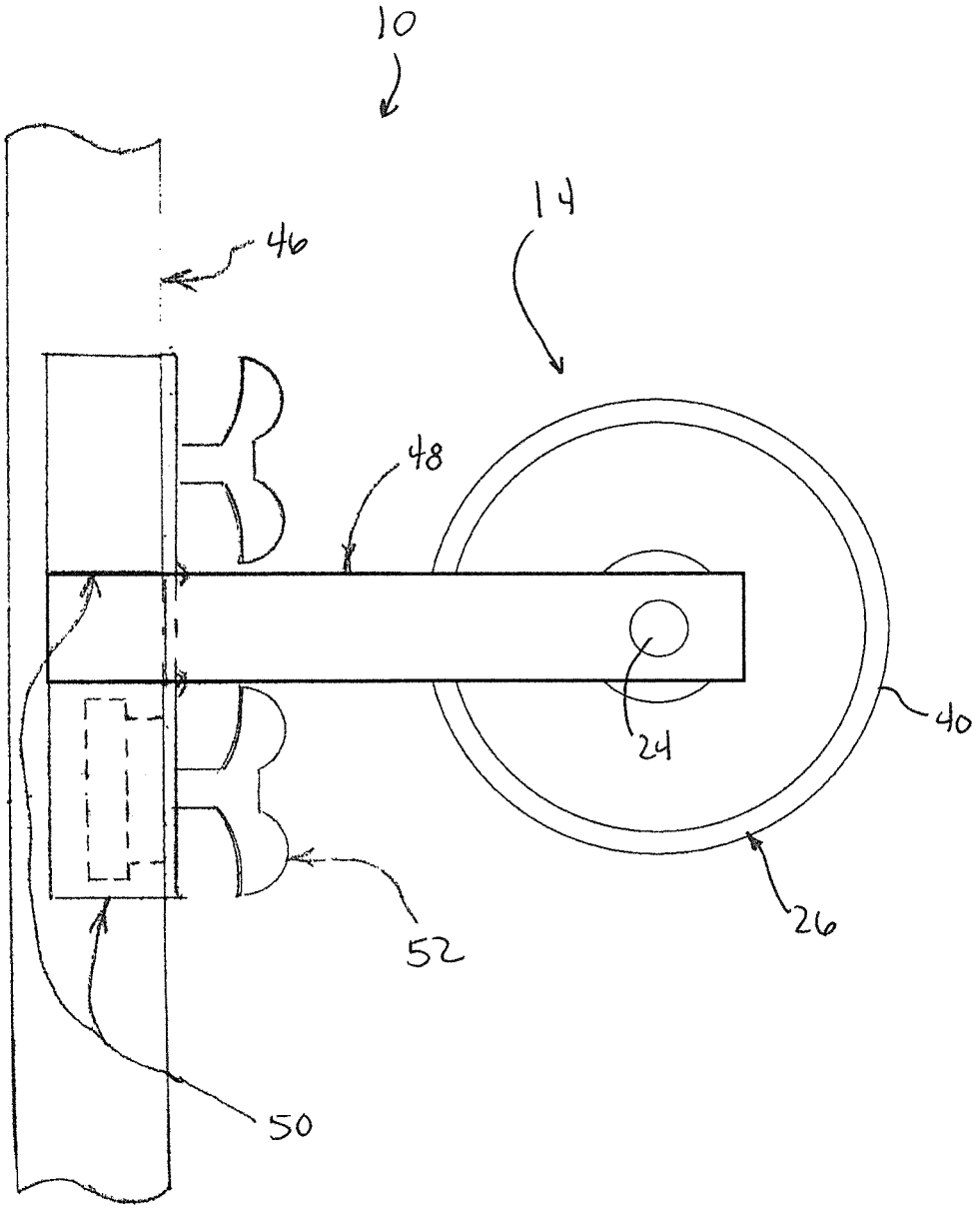

FIGS. 12 through 16 represent embodiments of therapy systems 10 comprising roller devices 14 that are mounted parallel to each other in a frame 46 that can be secured to a wall. By leaning against the roller devices 14, a user is able to use their legs to move their back vertically relative to the devices 14 to work the soft tissue on both sides of the spinal vertebrae. In FIGS. 12 through 14, the frame 46 is represented as a channel having a vertical orientation. Two sets of inserts 50 are adjustably secured to the frame 46 with thumb screws 52, though it is foreseeable that an automated adjustment mechanism could be used. A bracket 48 is secured to each insert 50, and each bracket 48 has a pair of arms rotatably coupled to opposite axial end portions 24 of a roller device 14. The two roller devices 14 represented in FIGS. 12, 13 and 14 have rollers 26 of approximately equal size and shape (disk-shaped), including approximately equal widths (contact surfaces 40) and outer diameters. The vertical locations of the roller devices 14 on the frame 46 and relative to each can be adjusted with the inserts 50. The rollers 26 are preferably mounted to rotate relative to their axle portions 30 and independently of each other. The system 10 represented in FIGS. 12 through 15 may be modified to use a single roller device 14 or more than two roller devices 14. In addition, the roller devices 14 represented in FIGS. 12 through 15 may be replaced by roller devices 14 with rollers 26 having other shapes and sizes, including those represented in FIGS. 1 and 3 through 11. A particular example is a roller device 14 having a similar configuration to the center device 14 of FIG. 9, which is believed to be particularly effective for the neck vertebrae.

The upper roller device 14 comprises four rollers 26 spaced apart by axle portions 30, and the lower roller device 14 comprises two rollers 26 spaced apart by a single axle portion 30. For the purpose of applying pressure to the soft tissue on both sides of the spinal column, the outer diameters (D) of the rollers 26 may be about 5 to about 15 centimeters and the contact surface radii (r) of the rollers 26 may be about 0.5 to 2.5 centimeters. The different numbers of rollers 26 on the devices 14 allow for different therapeutic effects, for example, fewer rollers 26 promote deeper tissue penetration. The two rollers 26 of the lower roller device 14 and the two center rollers 26 of the upper device 14 are preferably spaced apart a sufficient distance so as not to apply pressure to the spinal vertebrae. For this purpose, preferred axial distances between these rollers 26 are believed to be greater than 3, preferably about 6 to about 8 centimeters. The outermost rollers 26 of any roller device 14 are preferably less than 15 centimeters apart to avoid applying pressure to the kidneys.

Figure 15:
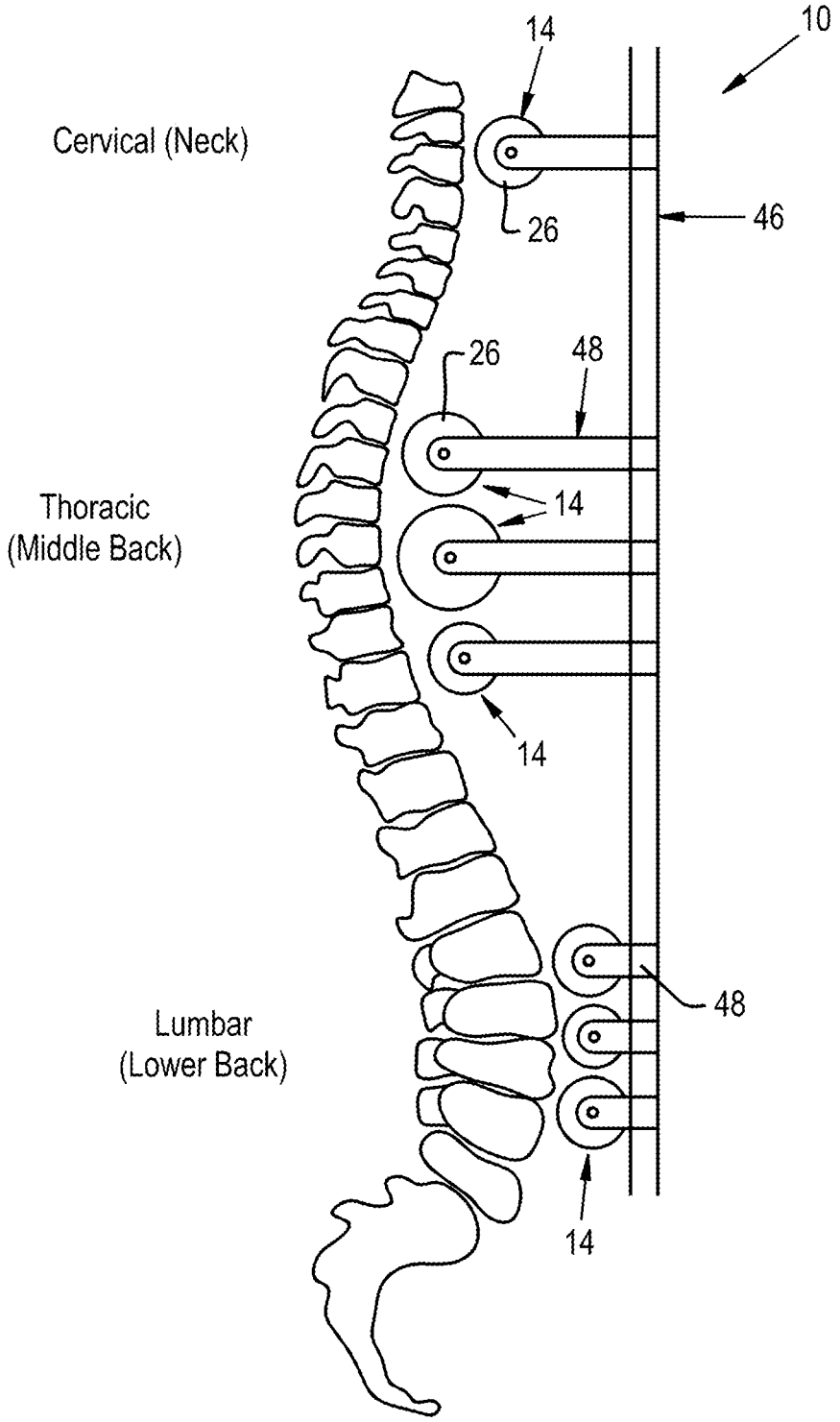
FIG. 15 represents a therapy system positioned in proximity to a spinal column and comprising multiple roller devices especially adapted to perform therapy on certain regions of the spinal column in accordance with nonlimiting embodiments of this invention.

FIG. 15 schematically represents an embodiment in which multiple roller devices 14 are strategically spaced along the length of the frame 46 for the purpose of working soft tissue within certain regions along the spinal vertebrae. Notably, the outer diameters of the rollers 26 may vary with the region to be worked with the system 10.

Figure 16:
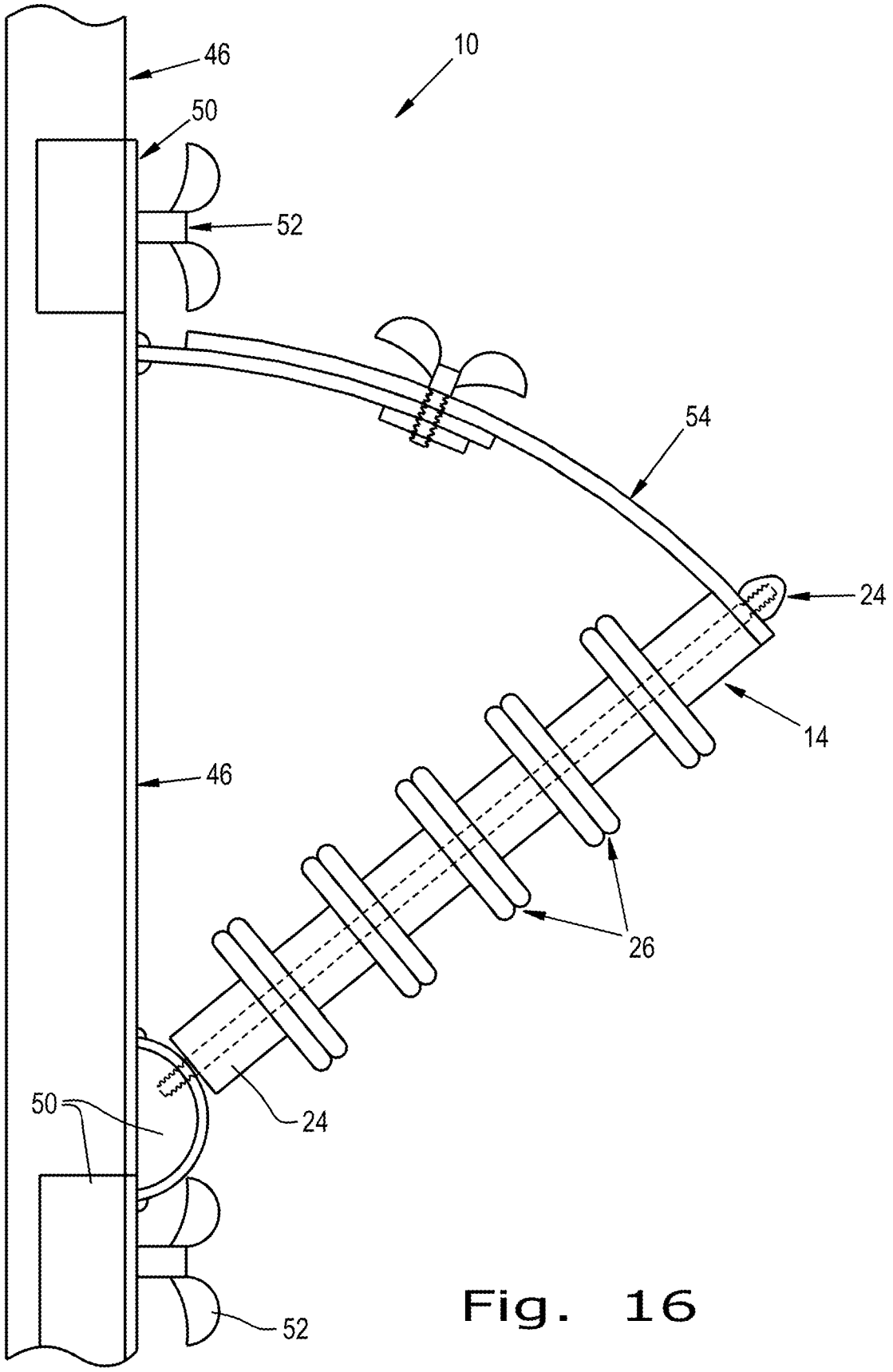
FIG. 16 represents a side view of a therapy system comprising a roller device pivotally mounted and configured for mounting to a wall in accordance with nonlimiting embodiments of this invention.

FIG. 16 schematically represents a manner in which a roller device 14 can be mounted to the frame 46 to work soft tissue in the shoulder regions of a user. In particular, the roller device 14 is represented as being pivotally connected at its lower end portion 24 to an insert 48 adjustably mounted to the frame 46, and mounted at its upper end portion 24 to a bracket 54 with which the roller device 14 can be adjustably secured at an angle of the frame 46. The roller device 14 represented in FIG. 16 may be replaced by roller devices 14 with rollers 26 having other shapes and sizes, including those represented in FIGS. 1 and 3 through 15.

The roller devices 14 and other structures depicted in the drawings can be fabricated from a variety of materials, including wood, metal, and hard polymeric materials. In some cases, it may be desirable to form the rollers 26, or at least their contact surfaces 40, from a material having an antimicrobial effect, for example, copper, copper alloys, brass, etc. In addition or alternatively, the devices 14 may be fabricated from materials, for example, steel plated with copper, which can be heated or chilled prior to use. If heated, the devices 14 may increase flow of lymphatic fluid, increase localized blood flow by vasodilation, increase connective tissue extensibility, facilitate gliding of nerves and tendons, etc. If chilled, the devices 14 may produce analgesia, reduce inflammation, and reduce edema.

While the invention has been described in terms of specific embodiments, it is apparent that other forms could be adopted by one skilled in the art. For example, the roller devices 14, support 12, frame 46, etc., could differ in appearance and construction from the embodiments shown in the Figures, and the functions of certain components could be performed by components of different construction but capable of a similar (though not necessarily equivalent) function. Accordingly, it should be understood that the invention is not limited to the specific embodiments illustrated in the Figures. It should also be understood that the phraseology and terminology employed above are for the purpose of disclosing the illustrated embodiments, and do not necessarily serve as limitations to the scope of the invention. Therefore, the scope of the invention is to be limited only by the following claims.

The invention claimed is:

1. A therapeutic kit adapted to perform therapy on soft tissue beneath the skin within a body region of an individual's body through a rolling application of pressure, the kit comprising at least a first roller device comprising:

an axis of rotation;

oppositely-disposed ends on the axis of rotation;

at least first and second rollers and a center roller therebetween, the center, first, and second rollers being oriented perpendicular to the axis of rotation and spaced apart from each other between the oppositely-disposed ends of the first roller device along the axis of rotation thereof so as to define axial gaps between the center, first, and second rollers, the center roller being at a center of the first roller device between the oppositely-disposed ends such that the first roller device is symmetrical about the center roller, the center, first and second rollers being sized and configured to provide substantially continuous lines of contact with the individual's skin, each of the center, first and second rollers having a circular perimeter that defines an outer diameter and a contact surface of the roller, the contact surface extending between axial ends of the roller thereof to define a contact surface radius sized so that the center, first and second rollers apply levels of pressure to the soft tissue beneath the skin when the first roller device is pressed with a level of force against the skin of the individual and caused to travel across the skin within the body region of the individual's body; and a portable support comprising a pliable nonrigid pad, a more rigid substrate that supports the pliable nonrigid pad, and a pliant material that supports the more rigid substrate, the portable support being sized and shaped to support the body region while the first roller device is between the body region and the pliable nonrigid pad and the first roller device is rolled between the body region and the pliable nonrigid pad to perform therapy on the body region, the pliable nonrigid pad being at least one centimeter thick so that the first roller device sufficiently penetrates the pliable nonrigid pad to cause a drag that resists rolling of the first roller device.

2. The therapeutic kit according to claim 1, wherein the outer diameters of the first and second rollers are different from the outer diameter of the center roller and the contact surface radii of the first and second rollers are different from the contact surface radius of the center roller to apply different levels of pressure to soft tissue beneath the skin.

3. The therapeutic kit according to claim 1, wherein the outer diameters of the center, first and second rollers are the same and the contact surface radii of the center, first and second rollers are the same to apply approximately equal levels of pressure to the soft tissue beneath the skin.

4. The therapeutic kit according to claim 1, wherein the first roller device further comprises at least one rib within each of the axial gaps between the center and first rollers and between the center and second rollers, each of the ribs radially projecting within the axial gap thereof and having a circular perimeter that defines an outer diameter and a contact surface of the rib, the contact surface of the rib defines a contact surface radius of the rib, and the outer diameter and contact surface radius of each of the ribs are less than the outer diameter and contact surface radius of each of the center, first and second rollers.

5. The therapeutic kit according to claim 1, wherein the center, first and second rollers are interconnected by the first roller device to simultaneously rotate with each other.

6. The therapeutic kit according to claim 1, the outer diameters of the center, first and second rollers are approximately equal to each other and the contact surface radii of the center, first and second rollers are approximately equal to each other to apply approximately equal levels of pressure to the soft tissue beneath the skin, the system further comprising:

a second roller device having an axis of rotation and at least third and fourth rollers oriented perpendicular to the axis of rotation of the second roller device and spaced apart along the axis of rotation of the second roller to provide substantially continuous lines of contact with the individual's skin, each of the third and fourth rollers having a circular perimeter that defines an outer diameter and a contact surface of the roller, the contact surfaces of the third and fourth rollers defining contact surface radii of, respectively, the third and fourth rollers.

7. The therapeutic kit according to claim 6, wherein the contact surface radii of the center, first and second rollers are approximately equal to each other but different from the contact surface radii of the third and fourth rollers.

8. The therapeutic kit according to claim 6, wherein the outer diameters of the first, second, third and fourth rollers are approximately equal to each other.

9. The therapeutic kit according to claim 6, the system further comprising means for interconnecting the second roller device parallel to the first roller device.

10. The therapeutic kit according to claim 1, wherein the outer diameters of the center, first and second rollers are about 1 to about 2.5 centimeters and the contact surface radii of the center, first and second rollers are at least 0.3 centimeter.

11. The therapeutic kit according to claim 10, wherein the contact surface radii of the center, first and second rollers are up to one-half of the outer diameters thereof.

12. The therapeutic kit according to claim 10, wherein the center, first and second rollers are spaced apart along the axis of rotation of the first roller device a distance of at least 1.5 up to about 6 centimeters.

13. The therapeutic kit according to claim 1, wherein:

each of the center, first, and second rollers is defined by at least first and second disks, the first and second disks of each corresponding one of the center, first, and second rollers having equal outer diameters and defining the outer diameter of the corresponding one of the center, first, and second rollers; and the first roller device further comprises a plurality of ribs within each of the axial gaps between the center and first rollers and between the center and second rollers, each of the plurality of ribs radially projecting within the axial gap thereof and having a circular perimeter that defines an outer diameter and a contact surface of the rib, the outer diameter of each of the plurality of ribs is less than the outer diameter of each of the center, first and second rollers, the plurality of ribs within each of the axial gaps comprising first and second ribs, and the outer diameters of the first ribs being different from the outer diameters of the second ribs.

14. The therapeutic kit according to claim 1, wherein the first roller device further comprises at least third, fourth, and fifth rollers equally spaced along the axis of rotation of the first roller device, each of the third, fourth, and fifth rollers having an outer diameter and a contact surface radius approximately equal to, respectively, the outer diameters and contact surface radii of the center, first and second rollers, the system further comprising second and third roller devices each having an axis of rotation, the second and third roller devices being interconnected in parallel to each other and to the first roller device, the second and third roller devices each comprising at least five rollers equally spaced apart along the respective axis of rotation thereof, each of the five rollers of each of the second and third roller devices having an outer diameter approximately equal to each other and to the outer diameters of the first, second, third, fourth and fifth rollers of the first roller device, each of the five rollers of the second and third roller devices having a contact surface radius that is different from the contact surface radii of the first, second, third, fourth and fifth rollers of the first roller device, the five rollers of the second roller device defining gaps therebetween that are approximately equal to each other and to gaps between the five rollers of the third roller device but different from gaps between the first, second, third, fourth and fifth rollers of the first roller device.

15. The therapeutic kit according to claim 1, the first roller device comprising two handles mounted at the oppositely-disposed ends of the axis of rotation so that the center, first and second rollers are between the handles and simultaneously rotate with each other but not with the handles.

16. The therapeutic kit according to claim 15, the system further comprising a second roller device having an axis of rotation and at least third and fourth rollers oriented perpendicular to the axis of rotation of the second roller device and spaced apart along the axis of rotation of the second roller to provide substantially continuous lines of contact with the individual's skin, each of the third and fourth rollers having a circular perimeter that defines an outer diameter and a contact surface of the roller, the contact surface of each of the third and fourth rollers defining a contact surface radius of, respectively, the third and fourth rollers, wherein the outer diameters and the contact surface radii of the third and fourth rollers are approximately equal to each other but are different from the contact surface radii of the center, first and second rollers of the first roller device.

17. The therapeutic kit according to claim 1, the system further comprising:

a second roller device having an axis of rotation and at least third and fourth rollers oriented perpendicular to the axis of rotation of the second roller device and spaced apart along the axis of rotation of the second roller to provide substantially continuous lines of contact with the individual's skin, each of the third and fourth rollers having a circular perimeter that defines an outer diameter and a contact surface of the roller, the contact surface of each of the third and fourth rollers defining a contact surface radius of, respectively, the third and fourth rollers; and mounting means for interconnecting the second roller device in parallel to the first roller device and securing the center, first and second roller devices to a wall.

18. The therapeutic kit according to claim 17, wherein the outer diameters of the first, second, third and fourth rollers are approximately equal to each other.

19. The therapeutic kit according to claim 17, wherein the outer diameters of the center, first and second rollers of the first roller device are approximately equal to each other and the outer diameters of the third and fourth rollers of the second roller device are approximately equal to each other but different from the outer diameters of the center, first and second rollers of the first roller device.

20. The therapeutic kit according to claim 17, wherein the outer diameters of the first, second, third and fourth rollers are about 5 to about 15 centimeters, the contact surface radii of the first, second, third and fourth rollers are about 0.5 to 2.5 centimeters, the center, first and second rollers are spaced apart along the axis of rotation of the first roller device a distance of greater than 3 to less than 15 centimeters, and the third and fourth rollers are spaced apart along the axis of rotation of the second roller device a distance of greater than 3 to less than 15 centimeters.

21. The therapeutic kit according to claim 1, wherein at least one of the center, first and second rollers is disk-shaped and the contact surface thereof is a flat contact surface that has a contact surface radius of infinity.

22. A method of using the therapeutic kit according to claim 6, the method comprising:

causing unidirectional or bidirectional movement of the first roller device across the body region to produce a cutting effect in the body region; and then causing unidirectional or bidirectional movement of the second roller device across the body region to produce a flushing or finishing effect in the body region that promotes flow of lymphatic fluid and/or blood away from the body region.

* * * * *